US008231211B2

(12) United States Patent
Okawa

(10) Patent No.: US 8,231,211 B2
(45) Date of Patent: Jul. 31, 2012

(54) IMAGE RECORDING APPARATUS AND INK CIRCULATION CONTROL METHOD

(75) Inventor: Kenichi Okawa, Hachioji (JP)

(73) Assignee: Riso Kagaku Corporation, Tokyo (JP)

( * ) Notice: Subject to any disclaimer, the term of this patent is extended or adjusted under 35 U.S.C. 154(b) by 946 days.

(21) Appl. No.: 12/077,511

(22) Filed: Mar. 19, 2008

(65) Prior Publication Data

US 2008/0284809 A1 Nov. 20, 2008

(30) Foreign Application Priority Data

May 17, 2007 (JP) ..... 2007-131860

(51) Int. Cl.
*B41J 2/18* (2006.01)

(52) U.S. Cl. ..... 347/89; 347/60

(58) Field of Classification Search ..... 347/60, 347/89

See application file for complete search history.

(56) References Cited

U.S. PATENT DOCUMENTS

| | | | | |
|---|---|---|---|---|
| 5,291,215 | A * | 3/1994 | Nozawa et al. | 347/18 |
| 6,086,194 | A * | 7/2000 | Ikezaki | 347/88 |
| 7,121,648 | B2 * | 10/2006 | Iida et al. | 347/60 |
| 7,380,927 | B2 * | 6/2008 | Shigemura | 347/89 |

FOREIGN PATENT DOCUMENTS

| | | | |
|---|---|---|---|
| JP | EP 0317341 | * | 5/1989 |
| JP | 10-175308 | A | 6/1998 |
| JP | 2004-216758 | A | 8/2004 |

OTHER PUBLICATIONS

Japanese Office Action dated Jan. 17, 2012 (and English translation thereof) in counterpart Japanese Application No. 2007-131860.

* cited by examiner

*Primary Examiner* — Charlie Peng
(74) *Attorney, Agent, or Firm* — Holtz, Holtz, Goodman & Chick, PC

(57) ABSTRACT

An image recording apparatus according to the invention includes a recording unit which jets ink from a nozzle array formed by plural nozzles communicated with each ink chamber, an ink tank in which the ink is stored, and an ink circulation unit which circulates the ink between the recording unit and the ink tank. In the image recording apparatus, control contents are determined in controlling the ink circulation unit based on analysis result of job information, notified by a host apparatus, for performing recording process of recording data, nozzle array temperature detection information on detected temperature in each ink chamber, and ink tank temperature detection information on detected temperature of the ink in the ink tank, and the ink circulation unit is controlled based on the determined control contents.

9 Claims, 5 Drawing Sheets

IMAGE RECORDING APPARATUS AND INK CIRCULATION CONTROL METHOD

CROSS-REFERENCE TO RELATED APPLICATIONS

This application is based upon and claims the benefit of priority from prior Japanese Patent Application No. 2007-131860, filed May 17, 2007, the entire contents of which are incorporated herein by reference.

BACKGROUND OF THE INVENTION

1. Field of the Invention

The present invention relates to an image recording technique of ejecting ink to a recording medium such as paper and a film to record an image, and particularly to ink temperature control and ink circulation control techniques in an image recording apparatus.

2. Description of the Related Art

Conventionally, an inkjet image recording apparatus is frequently used in an output apparatus such as a facsimile and a copying machine. In a recording process of the inkjet image recording apparatus, the ink is ejected from plural nozzles formed in a recording head based on recording data and the ejected ink drops are appropriately fixed on a recording medium. Generally, viscosity is changed depending on a temperature in the ink used in the image recording apparatus. A shape and a size of the ink drop ejected from the nozzle vary when the ink viscosity is changed during the recording process (image recording). The variations in shape and size of the ink drop do not become troublesome in the case of the small change in ink viscosity. On the other hand, in the case of the large change in ink viscosity, uneven density and color difference are conspicuous in the image formed on the recording medium.

The ink is unstably ejected from the nozzle in the inkjet image recording apparatus when the ink temperature is out of a predetermined temperature range (out of recommended temperature range) in which the recording process can be performed. In the inkjet image recording apparatus, undesirably physicality of the ink is changed when the ink temperature increases excessively out of the predetermined temperature range. Additionally, in the inkjet image recording apparatus, when the ink temperature is out of the predetermined temperature range, possibly a satellite ink drop (unexpected small ink drop) and an ink mist in which the ink is ejected in the form of a mist are generated in addition to the main ink drop which is ejected from the nozzle and lands in the recording medium.

Therefore, in the inkjet image recording apparatus, in order to prevent the generation of the satellite or ink mist, it is necessary that the ink temperature be maintained in the predetermined temperature range to keep the ink viscosity constant.

For example, Jpn. Pat. Appln. KOKAI Publication No. 10-175308 discloses an inkjet printer. In a configuration of this inkjet printer, an ink tank in which a heater is provided and a print head are connected, and another ink tank and the print head are connected in order to return the ink supplied to the print head to the ink tank. In this inkjet printer, the ink is circulated while the ink temperature is controlled by the heater provided in the ink tank, and a recording operation (recording process) is performed by the print head while the ink temperature is kept within the set temperature range.

BRIEF SUMMARY OF THE INVENTION

An image recording apparatus according to an aspect of the present invention comprises: at least one recording unit which includes at least one nozzle array formed by a plurality of nozzles communicated with each ink chamber, and performs control of a temperature of ink stored in said each ink chamber and acquisition of nozzle array temperature detection information at the temperature of the stored ink; an ink tank in which control of a temperature of the stored ink and acquisition of ink tank temperature detection information at the temperature of the stored ink are performed; an ink circulation unit which performs nozzle array ink circulation, the ink stored in the ink tank being returned to the ink tank after the ink passes through said each ink chamber; and an ink circulation control unit which determines control contents in controlling the ink circulation unit based on analysis result of job information notified by a host apparatus, the nozzle array temperature detection information, and the ink tank temperature detection information, and controls the ink circulation unit based on the determined control contents.

According to another aspect of the present invention, there is provided a method for controlling ink circulation of an image recording apparatus which includes: at least one recording unit which includes at least one nozzle array formed by a plurality of nozzles communicated with each ink chamber, and performs control of a temperature of ink stored in said each ink chamber and acquisition of nozzle array temperature detection information at the temperature of the stored ink; an ink tank in which control of a temperature of the stored ink and acquisition of ink tank temperature detection information at the temperature of the stored ink are performed; and an ink circulation unit which performs nozzle array ink circulation, the ink stored in the ink tank being returned to the ink tank after the ink passes through said each ink chamber, the method comprising: analyzing job information notified by a host apparatus; determining control contents in controlling the ink circulation unit based on the nozzle array temperature detection information and the ink tank temperature detection information; and controlling the ink circulation unit based on the determined control contents.

DETAILED DESCRIPTION OF THE INVENTION

An embodiment of the invention will be described below with reference to the drawings.

Figure 1:
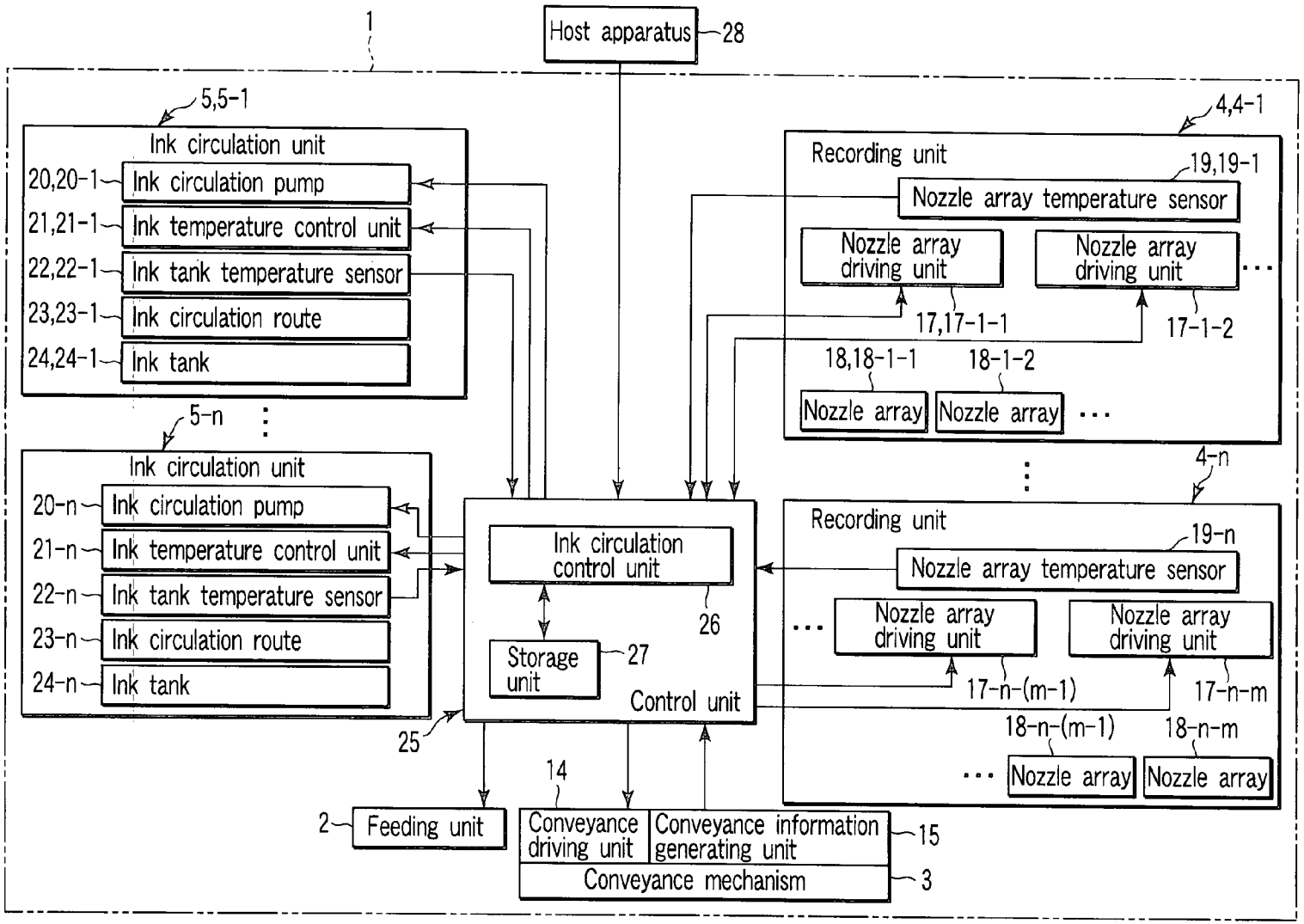
FIG. 1 is a block diagram schematically showing an image recording apparatus according to an embodiment of the invention.

FIG. 1 is a block diagram schematically showing an image recording apparatus according to an embodiment of the invention. In FIG. 1, suffixes n and m are added to the numeral of each component. The suffixes n and m are integer numbers (2≦n and 2≦m). The suffix n corresponds to the number of recording units and the suffix m corresponds to the number of nozzle arrays.

Figure 2:
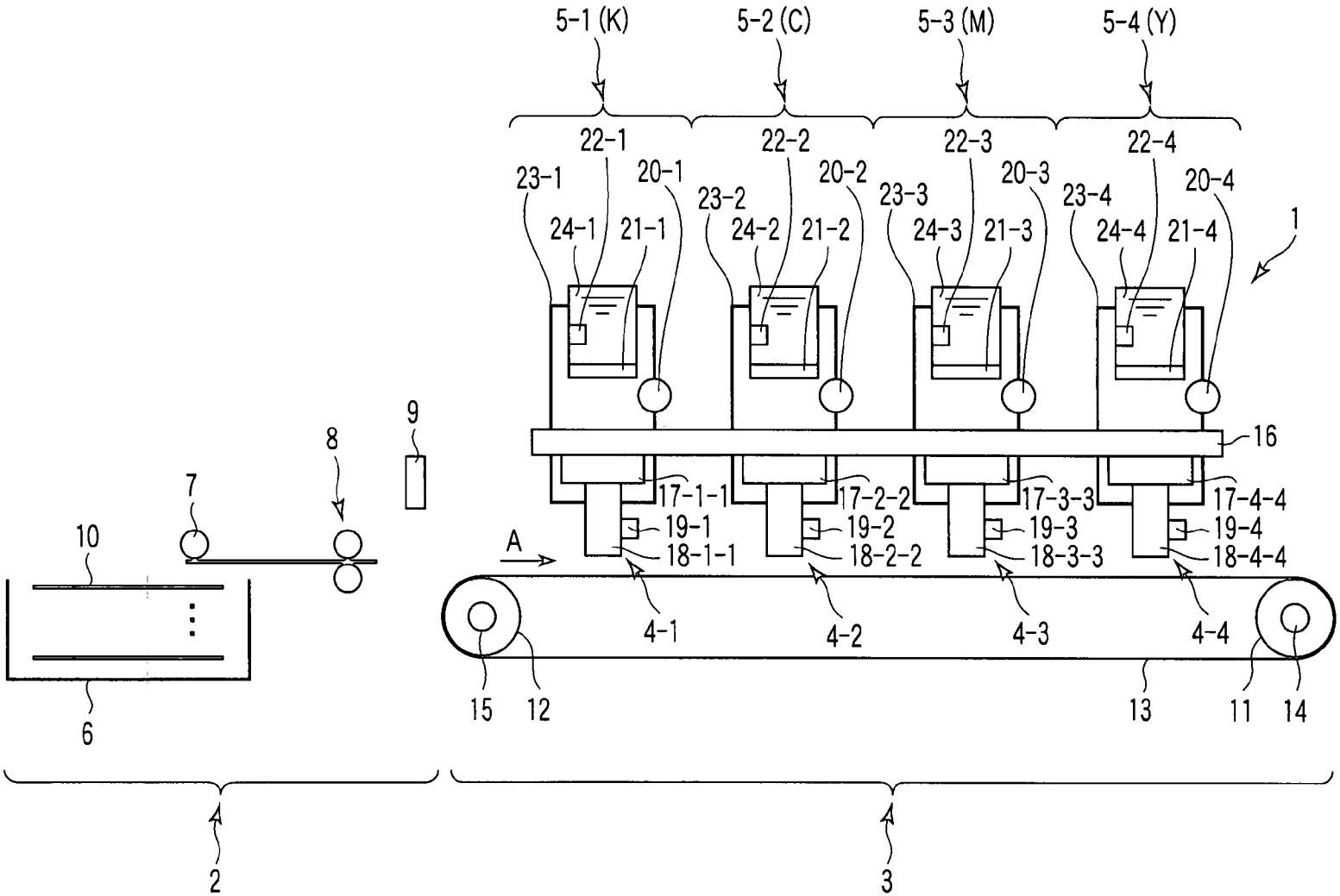
FIG. 2 is a schematic view showing a configuration of the image recording apparatus except for a control unit.

FIG. 2 schematically shows a configuration of the image recording apparatus except for a control unit. In FIG. 2, an image recording apparatus of the embodiment is considered to be a color image recording apparatus, and each recording unit is shown by a configuration in which one nozzle array is provided for each ink color.

The image recording apparatus 1 of the embodiment includes a feeding unit 2, a conveyance mechanism 3, at least one recording unit 4 (4-1 to **4-*n*), at least one ink circulation unit 5 (5-1 to 5-*n*), and a control unit 25**.

The feeding unit 2 is disposed on an uppermost stream side of a conveyance path of a recording medium 10. The feeding unit 2 includes a storage tray 6 in which the recording media 10 such as paper are stored while stacked, a feeding roller 7 which feeds the stacked recording media 10, a registration roller pair 8 which is disposed on a downstream side of the feeding roller 7, and an edge position detection unit 9 which is disposed on a downstream side of the registration roller pair 8.

In the feeding unit 2, by order of the control unit 25, the feeding roller 7 pick ups the topmost one of the stacked recording media 10 and conveys the recording medium 10 to the registration roller pair 8.

In the feeding unit 2, by order of the control unit 25, the recording medium 10 conveyed by the feeding roller 7 is caused to abut on the stopped registration roller pair 8 for a predetermined period to remedy skew of the recording medium 10. After the registration roller pair 8 of the feeding unit 2 remedies the skew of the recording medium 10, the registration roller pair 8 conveys the recording medium 10 onto the side of the edge position detection unit 9 while nipping the recording medium 10. The edge position detection unit 9 of the feeding unit 2 notifies the control unit 25 of detection information when detecting a position of an end portion of the conveyed recording medium 10 (for example, a front-end portion in a conveyance direction). A transmission type optical sensor, a reflection type optical sensor, or a capacitance type sensor is used as the edge position detection unit 9.

The conveyance mechanism 3 includes a driving roller 11 and a driven roller 12 which are provided in parallel while separated from each other in the conveyance direction of the recording medium 10. In the conveyance mechanism 3, a conveyance element 13 such as an endless belt having plural holes is entrained about the driving roller 11 and driven roller 12. In the conveyance mechanism 3, a conveyance driving unit 14 such as a motor is connected to a rotating shaft of the driving roller 11. A conveyance information generating unit 15 such as a rotary encoder is connected to a rotating shaft of the driven roller 12. In the conveyance mechanism 3, a suction fan is provided between the driving roller 11 and the driven roller 12.

In the conveyance mechanism 3, by order of the control unit 25, the recording medium 10 delivered from the feeding unit 2 is sucked through plural holes in the endless belt by driving the suction fan, and the recording medium 10 is conveyed onto the downstream side (A direction) in the conveyance path of the recording medium 10 while sucked on the endless belt.

The recording unit 4 (4-1 to **4-*n*) includes a nozzle array driving unit 17 (17-1-1 to 17-*n*-*m*), a nozzle array 18 (18-1-1 to 18-*n*-*m*) and a nozzle array temperature sensor 19 (19-1 to 19-*n***).

For example, a (K) black recording unit 4-1, a cyan (C) recording unit 4-2, a magenta (M) recording unit 4-3, and a yellow (Y) recording unit 4-4 are provided in the color image recording apparatus 1 of FIG. 2 in which ink colors of black (K), cyan (C), magenta (M), and yellow (Y) are used.

As shown in FIG. 2, the recording units 4-1 to 4-4 include nozzle arrays 18-1-1 to 18-4-4 when the nozzle array of each ink color is formed by one nozzle array. The recording units 4-1 to 4-4 include nozzle arrays 18-1-1 to 18-4-24 when the nozzle array of each ink color is formed by six nozzle arrays.

In the following description, it is assumed that the image recording apparatus 1 of the embodiment has the configuration shown in FIG. 2.

The number of nozzle array driving units 17 (17-1-1 to 17-4-4) corresponding to the number of nozzle arrays 18 (18-1-1 to 18-4-4) is provided as a driving circuit for driving the nozzle array 18.

In the nozzle array driving units 17-1-1 to 17-4-4, by order of the control unit 25, the plural nozzles possessed by the nozzle arrays 18-1-1 to 18-4-4 are driven to eject the ink.

The nozzle arrays 18-1-1 to 18-4-4 are configured by adopting a method of ejecting the ink stored in each of plural ink chambers by a volume change due to deformation of a piezoelectric transducer (PZT) provided in each ink chamber. The nozzle arrays 18-1-1 to 18-4-4 include a common ink flow channel, an ink inflow entrance, and an ink outflow entrance which are communicated with one another to pass the ink in each of the plural ink chambers. The detailed nozzle array 18 will be described later.

The number of nozzle array temperature sensors 19 (19-1 to 19-4) corresponding to the number of recording units 4 is provided. The nozzle array temperature sensors 19-1 to 19-4 detect an ink temperature in a common ink flow channel **18*c* through which the nozzle array 18 is communicated with each of the plural ink chambers, and the nozzle array temperature sensor 19 notifies the control unit 25** of the detected ink temperature information.

As shown in FIG. 2, the recording units 4-1 to 4-4 are suspended from a support element 16.

In the support element 16, the nozzle array 18-1-1 of the recording unit 4-1, the nozzle array 18-2-2 of the recording unit 4-2, the nozzle array 18-3-3 of the recording unit 4-3, and the nozzle array 18-4-4 of the recording unit 4-4 are provided at predetermined positions located at predetermined intervals in the conveyance direction (A direction) of the recording medium 10 based on the detection position of the edge position detection unit 9. The positions where the nozzle arrays 18 of the recording units 4 are provided are set as the numerical value of design/production of the image recording apparatus 1 and previously stored in a storage unit 27. The positions are set in terms of an accumulation value of a pulse signal of a rotary encoder in the conveyance information generating unit 15, and the accumulation of the accumulation value is started since the control unit 25 is notified of the detection position information of the edge position detection unit 9.

The ink circulation unit 5 (5-1 to 5-4) includes an ink circulation pump 20 (20-1 to **20-*n*), an ink temperature control unit 21 (21-1 to 21-*n*), an ink tank temperature sensor 22 (22-1 to 22-*n*), an ink circulation route 23 (23-1 to 23-*n*), and an ink tank 24 (24-1 to 24-*n***).

The number of ink tanks 24 (24-1 to 24-4) corresponding to the number of recording units 4 is provided, and the ink for circulation is stored in the ink tank 24. The detailed ink tank 24 will be described later.

The number of ink temperature control units 21 (21-1 to 21-4) corresponding to the number of recording units 4 is provided. By order of the control unit 25, the ink temperature control unit 21 (21-1 to 21-4) heats or heats/cools the ink stored in the ink tank 24 (24-1 to 24-4). The ink temperature control unit 21 (21-1 to 21-4) includes the heater only in the case where the ink is heated, and includes a Peltier device in addition to the heater in the case where the ink is also cooled.

The ink tank temperature sensor 22 (22-1 to 22-4) is provided in each ink tank 24. The ink tank temperature sensor 22 (22-1 to 22-4) detects the temperature of each color ink stored in the ink tank 24 (24-1 to 24-4), and notifies the control unit 25 of the temperature detection information.

The number of ink circulation routes 23 (23-1 to 23-4) corresponding to the number of recording units 4 is provided. The ink circulation route 23 (23-1 to 23-4) is used to circulate the ink between the ink tank 24 (24-1 to 24-4) and the nozzle array 18 (18-1-1 to 18-4-4). The detailed ink circulation route 23 (23-1 to 23-4) will be described later.

The number of ink circulation pumps 20 (20-1 to 20-4) corresponding to the number of recording units 4 is provided. The ink circulation pump 20 (20-1 to 20-4) is disposed in the middle of the ink circulation route 23 (23-1 to 23-4) through which the ink is caused to flow out from the recording unit 4 (4-1 to 4-4) to the ink tank 24 (24-1 to 24-4). The detailed ink circulation pump 20 (20-1 to 20-4) will be described later.

The control unit 25 includes an ink circulation control unit 26 and the storage unit 27, and controls various operations of the entire image recording apparatus 1.

The control unit 25 includes a microprocessor unit (MPU) having a control function and a computation function, a processing circuit having a read-only memory (ROM) in which a control program is stored and a random access memory (RAM) which acts as a work memory of the MPU, and a nonvolatile memory in which setting values concerning the control of the image recording apparatus 1 are stored. The control unit 25 stores the control program in the ROM, and performs the ink circulation and ink temperature control using the control program which is the ink circulation control unit 26. The control unit 25 causes the MPU to execute the control program to function as the ink circulation control unit 26. The storage unit 27 is formed by a nonvolatile memory. Setting values and the like used when the MPU executes the control program which is the ink circulation control unit 26 are stored in the storage unit 27.

A host apparatus 28 which is an external device of the image recording apparatus 1 of the embodiment is connected through a local area network (LAN). The host apparatus 28 corresponds to a user's computer which causes the image recording apparatus 1 of the embodiment to perform the recording process. The host apparatus 28 notifies the control unit 25 of job information. The job information includes information (recording data, recording medium specification information, specification information on the number of sheets to be recorded, and resolution specification information) concerning the recording process of the image recording apparatus 1.

A series of operations in the recording process based on the job information of the image recording apparatus of the embodiment will be described below. The MPU of the control unit 25 executes the predetermined control program concerning the recording process to perform the series of operations in the recording process.

The ink circulation control method of the image recording apparatus of the embodiment will be described later.

When the host apparatus 28 notifies the control unit 25 of the job information, the control unit 25 causes the feeding roller 7 to pick up the topmost recording medium 10 stacked on the storage tray 6 of the feeding unit 2 and to convey the recording medium 10 to the registration roller pair 8. At this point, the control unit 25 provides an instruction to the conveyance driving unit 14 of the conveyance mechanism 3 to start rotation of the endless belt. Then, the control unit 25 causes the recording medium 10 conveyed from the feeding roller 7 of the feeding unit 2 to abut on the suspended registration roller pair 8 of the feeding unit 2 for a predetermined period to remedy the skew of the recording medium 10. Then, the control unit 25 causes the registration roller pair 8 of the feeding unit 2 to nip the recording medium 10 to convey the recording medium 10 to the edge position detection unit 9.

Then, the control unit 25 is notified of end-portion position information when the edge position detection unit 9 detects the end-portion position (for example, a front-end portion in the conveyance direction) of the recording medium 10. Once the control unit 25 receives the end-portion position information detected by the edge position detection unit 9, the control unit 25 starts the accumulation of the rotary encoder signal in the conveyance information generating unit 15 of the conveyance mechanism 3. The recording medium 10 is conveyed from the feeding unit 2 while passed below the edge position detection unit 9. The control unit 25 sucks and holds the recording medium 10 on the endless belt through the plural holes in the endless belt by driving the suction fan, and conveys the recording medium 10 onto the downstream side (A direction) of the conveyance path.

The control unit 25 stores pieces of line data of 1 to k lines (k is an integer greater than or equal to 2) in the RAM of the control unit 25. The line data is the recording data as the job information of which the host apparatus 28 notifies the control unit 25.

On the other hand, as described above, in the control unit 25, the distance from the detection position of the edge position detection unit 9 to the nozzle array 18 of each color provided at predetermined position on the downstream side (A direction) of the conveyance path of the recording medium 10 is previously stored in the storage unit 27 in terms of the accumulation value of the rotary encoder signal in the conveyance information generating unit 15.

The control unit 25 starts to read each piece of line data of the pieces of line data of 1 to k lines from the RAM at a time the accumulation value of the rotary encoder signal generated in conveying the recording medium 10 sucked and held on the endless belt of the conveyance mechanism 3 is matched with the accumulation value of the rotary encoder signal corresponding to each nozzle array position previously stored in the storage unit 27. Then, the control unit 25 reads the pieces of line data of k lines as needed in synchronization with the rotary encoder signal. The control unit 25 causes the nozzle driving units 17 to drive the plural nozzles of the nozzle arrays 18 to eject each color ink based on the one line data, thereby performing the recording process.

The control unit 25 repeatedly performs the series of processes in which the recorded recording medium 10 is conveyed to a discharge unit provided on the downstream side of the conveyance path of the conveyance mechanism 3 according to the specification information on the number of sheets to be recorded of the job information of which the host apparatus 28 notifies the control unit 25.

The ink circulation unit and recording unit which are controlled based on the ink circulation control unit of the embodiment will be described below.

Figure 3:
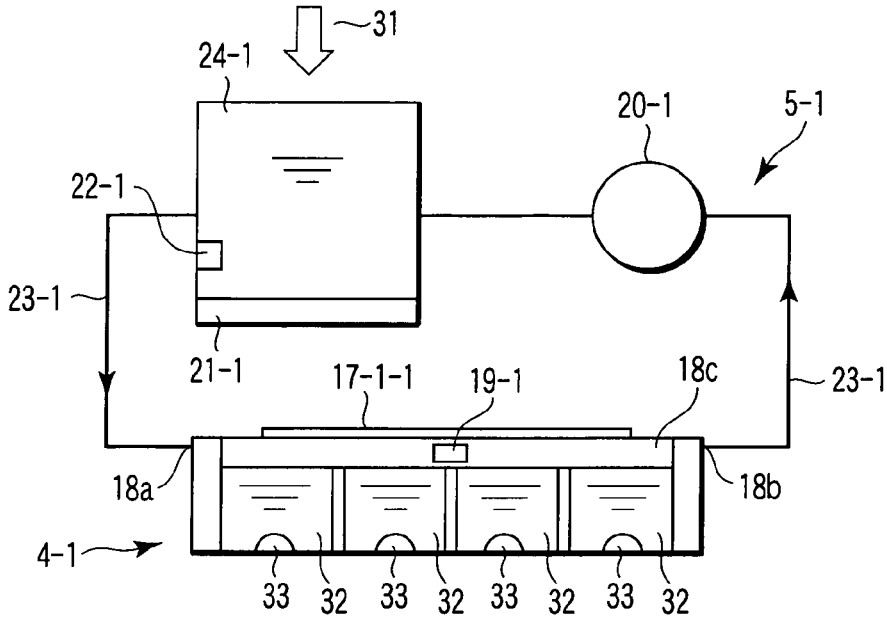
FIG. 3 is a schematic view showing a set of an ink circulation unit and a recording unit in the image recording apparatus.

FIG. 3 schematically shows a set of the ink circulation unit and recording unit of the embodiment. FIG. 3 shows the ink circulation unit 5-1 and the recording unit 4-1 of FIG. 2.

As described above, the ink tank 24-1 of the ink circulation unit 5-1 includes the ink tank temperature sensor 22-1 which detects the temperature of the stored ink and the ink temperature control unit 21-1 which heats/cools the stored ink. The ink tank temperature sensor 22-1 notifies the control unit 25 of ink tank temperature detection information on the temperature of the ink stored in the ink tank 24-1.

The ink tank 24-1 is configured such that the ink is replenished from an ink replenishment route 31 by an ink replenishment mechanism.

The ink circulation unit 5-1 includes the ink circulation route 23-1 branched into a path through which the ink flows in the recording unit 4-1 from the ink tank 24-1 and a path through which the ink flows out to the ink tank 24-1 from the recording unit 4-1. The ink circulation pump 20-1 is provided on the side of the path through which the ink flows out to the ink tank 24-1.

In the ink circulation unit 5-1, the ink circulation route 23-1 through which the ink flows into the recording unit 4-1 from the ink tank 24-1 is connected to an ink inflow entrance 18*a* of the nozzle array 18-1-1 of the recording unit 4-1, and the path through which the ink flows out to the ink tank 24-1 from the recording unit 4-1 is connected to an ink outflow entrance 18*b* of the nozzle array 18-1-1 of the recording unit 4-1.

The control unit 25 of the image recording apparatus 1 of the embodiment controls the ink circulation pump 20-1 based on the ink circulation control unit 26. The ink circulation pump 20-1 circulates the ink from the ink tank 24-1 to the ink chamber 32 provided in each of plural nozzles 33 in the nozzle array 18-1-1 of the recording unit 4-1.

The ink inflow entrance 18*a* and ink outflow entrance 18*b* of the nozzle array 18-1-1 are provided in the common ink flow channel 18*c*. Therefore, the ink stored in the ink chamber 32 provided in each of the plural nozzles 33 of the nozzle array 18-1-1 is communicated with the common ink flow channel 18*c*.

The recording unit 4-1 includes a nozzle array driving unit 17-1-1 and a nozzle array temperature sensor 19-1. The nozzle array driving unit 17-1-1 performs control in order to drive the nozzle array 18-1-1 to eject the ink stored in the plural ink chambers 32 from the plural nozzles 33.

The nozzle array temperature sensor 19-1 is provided in the common ink flow channel 18*c* of the nozzle array 18-1-1. The nozzle array temperature sensor 19-1 notifies the control unit 25 of the nozzle array temperature detection information on the temperature of the ink stored in the common ink flow channel 18*c*.

As described above, the nozzle array driving unit 17-1-1 controlled by the control unit 25 of the image recording apparatus 1 of the embodiment is formed by the method of ejecting the ink by the volume change of the nozzle array 18-1-1 due to the deformation of PZT provided in each ink chamber. In such cases, the nozzle array driving unit 17-1-1 includes the driving control circuit which drives PZT. The driving control circuit of PZT generates heat by repeatedly performing the control of the PZT deformation.

In the recording unit 4-1 of the embodiment, the ink stored in the plural ink chambers 32 of the nozzle array 18-1-1 is heated by utilizing the heat generated by the nozzle array driving unit 17-1-1.

The nozzle array driving unit 17-1-1 is provided in an outside wall of the common ink flow channel 18*c*. Therefore, the nozzle array driving unit 17-1-1 heats the ink stored in the plural ink chambers 32 by heat conduction of the heat generated by the nozzle array driving unit 17-1-1 to the ink through the outside wall of the common ink flow channel 18*c*.

The nozzle array driving unit 17-1-1 controlled by the control unit 25 controls the PZT deformation of the nozzle array 18-1-1 to an extent that the ink stored in the ink chamber 32 is not ejected from the nozzle 33. Therefore, the control unit 25 can use the heat generated by the nozzle array driving unit 17-1-1 to heat the ink stored in the plural ink chambers 32 without ejecting the ink from the plural nozzles of the nozzle array 18-1-1.

In the recording unit 4 of the embodiment, the recording unit 4 includes the one nozzle array 18-1-1. Alternatively, for example, the recording unit 4 may include the plural nozzle arrays 18 of the nozzle array 18-1-1, nozzle array 18-1-2, nozzle array 18-1-3, nozzle array 18-1-4, nozzle array 18-1-5, and nozzle array 18-1-6.

In such cases, the ink inflow entrance 18*a* and the ink outflow entrance 18*b* of each of the nozzle array 18-1-1 to nozzle array 18-1-6 are connected to the common ink flow channel 18*c* as the ink circulation route in the recording unit 4. In the recording unit 4, it is necessary that the heat generated by each of the nozzle array driving units 17-1-1 to 17-1-6 be thermally conducted to the ink stored in the common ink flow channel 18*c* when the nozzle array driving units 17-1-1 to 17-1-6 are provided in the common ink flow channel 18*c*.

Ink circulation control processing to the ink circulation unit and recording unit controlled based on the ink circulation control unit of the embodiment will be described below.

The ink circulation control processing will be described with reference to FIGS. 1 and 3, and the numerals are defined as follows.

(Definition of Numerals)

It is assumed that H1 is a temperature of the ink stored in the ink tank.

It is assumed that H2 is a temperature of the ink stored in the ink chamber communicated with the common ink flow channel 18*c* and plural nozzles.

It is assumed that H3 is an ink temperature range suitable for a recording process of the ink specified by the recording data of the job information.

It is assumed that D1 is a total amount of ink stored in the ink chamber communicated with the common ink flow channel 18*c* and plural nozzles.

It is assumed that D2 is a total amount of ink consumed by performing the job in terms of the total number of jets of the ink ejected from the plural nozzles in the recording process.

In a timing chart of the ink circulation control processing of the embodiment, a "job information notification" time is set to an origination, and "nozzle array temperature control", "ink tank temperature control", "ink circulation", and "recording process" performing times will be described in comparison with the "job information notification" time.

Figure 4:
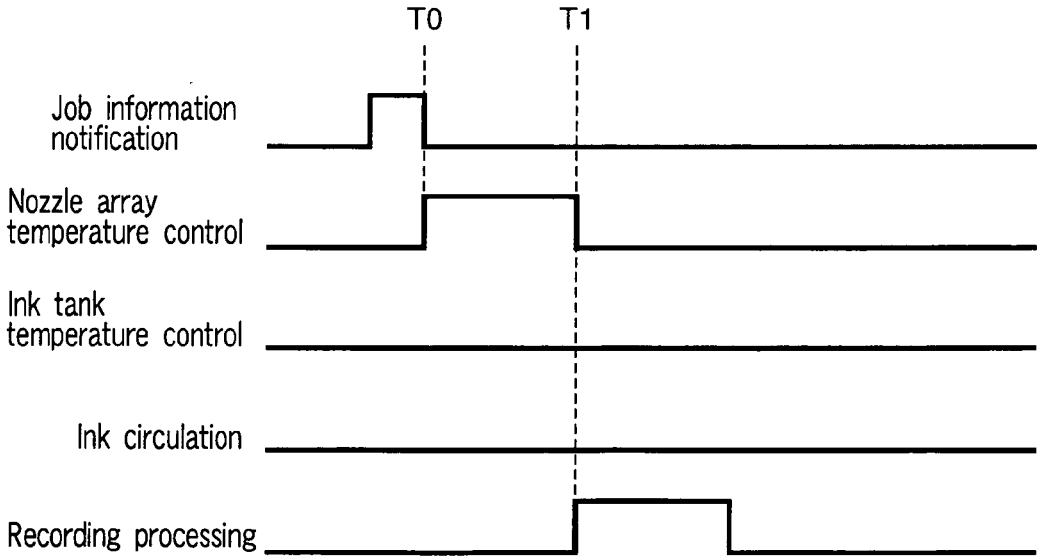
FIG. 4 is a timing chart showing first ink circulation control processing in the image recording apparatus.

FIG. 4 is a timing chart showing first ink circulation control processing of the embodiment.

In the first ink circulation control processing, as a result of analysis by the ink circulation control unit 26 of the job information of which the host apparatus 28 notifies the ink circulation control unit 26, the recording process which is the analyzed job information can be performed only by the ink stored in the ink chamber 32 communicated with the common ink flow channel 18*c* and the plural nozzles of the nozzle array 18-1-1.

When the ink circulation control unit 26 determines "D1>D2" and "H3>H2" at a notification time T0 of the job information by the host apparatus 28, the control unit 25 drives the nozzle array driving unit 17-1-1 at the notification time T0 to heat the ink stored in the plural ink chambers 32 of the nozzle array 18-1-1.

The ink temperature H3 is a proper ink usage temperature for the ink used in the recording process specified by the recording data of the job information of which the host apparatus 28 notifies the ink circulation control unit 26. A recommended temperature range (optimum ink temperature) of each ink color is previously stored in the storage unit 27 of the control unit 25. The total amount of ink D1 stored in the common ink flow channel 18*c* and the plural ink chambers 32 of the nozzle array 18-1-1 is previously stored in the storage unit 27. The total amount of ink D1 is computed from a volume of the ink flow channel 18*c* which is the numerical value of design/production of the image recording apparatus 1 and the total volume of the plural ink chambers 32 of the nozzle array 18-1-1. In the total amount of ink D1 stored in the storage unit 27, the total amount of ink remaining in the common ink flow channel 18*c* and the plural ink chambers 32 of the nozzle array 18-1-1 is computed using the total amount of ink consumed by performing the last-time (previous) job, when the recording process performed by the last-time (previous) job is ended in the recording process in which the ink circulation is not performed in the image recording apparatus 1. The control unit 25 then causes the storage unit 27 to store this total amount.

The control unit 25 drives the nozzle array driving unit 17-1-1 to heat the ink stored in the plural ink chambers 32 of the nozzle array 18-1-1. In this case, the control unit 25 drives the nozzle array driving unit 17-1-1 to an extent that the ink stored in the plural ink chambers 32 of the nozzle array 18-1-1 is not ejected from the plural nozzles 33. The drive is realized by setting a voltage to a level lower than a normal application voltage used to eject the ink from the plural nozzles 33 of the nozzle array 18-1-1. The normal application voltage set to the nozzle array driving unit 17-1-1 by the control unit 25 and the voltage lower than the normal application voltage are previously stored in the storage unit 27.

Thus, the control unit 25 drives the nozzle array driving unit 17-1-1 set to the level lower than the normal application voltage read from the storage unit 27 in order to heat the ink stored in the plural ink chambers 32 of the nozzle array 18-1-1.

The control unit 25 suspends the drive of the nozzle array driving unit 17-1-1 which is the heating of the ink stored in the plural ink chambers 32 of the nozzle array 18-1-1 at a time T1 when the ink temperature H2 of the heated ink becomes "H3≦H2". Then, the control unit 25 starts the recording process by driving the nozzle array driving unit 17-1-1 at the normal application voltage.

Figure 5:
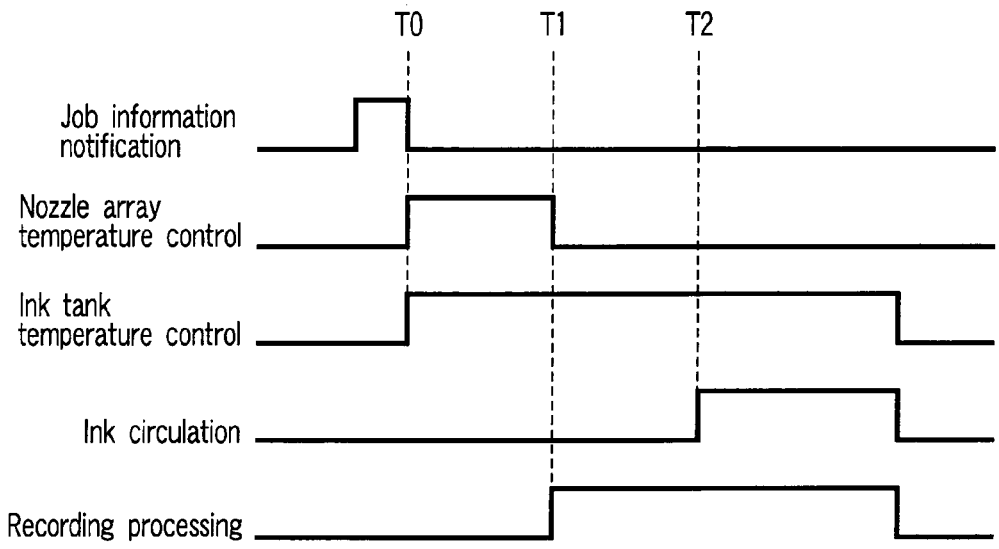
FIG. 5 is a timing chart showing second ink circulation control processing in the image recording apparatus.

FIG. 5 is a timing chart showing second ink circulation control processing of the embodiment.

In the second ink circulation control processing, as a result of analysis by the ink circulation control unit 26 of the job information of which the host apparatus 28 notifies the ink circulation control unit 26, the recording process which is the analyzed job information is not performed only by the ink stored in the ink chamber 32 communicated with the common ink flow channel 18*c* and the plural nozzles of the nozzle array 18-1-1, but the ink circulation is started in the middle of the recording process of the job to replenish the ink used in the recording process. However, in the job, in the result analyzed by the ink circulation control unit 26, the ink temperature control unit 21-1 determines that the ink temperature of the ink stored in the ink tank 24-1 can be controlled in the recommended usage temperature range until the ink circulation is started in the middle of the recording process since the recording process of the job is started.

That is, at a notification time T0 of the job information by the host apparatus 28, when the ink circulation control unit 26 determines "D1<D2" and "H3>H2", and when the ink circulation control unit 26 determines that the ink temperature in the ink tank 24-1 becomes "H3≦H1" during the recording process using the ink stored in the ink chamber 32 communicated with the plural nozzles, the heating of the ink stored in the plural ink chambers 32 of the nozzle array 18-1-1 by the drive of the nozzle array driving unit 17-1-1 and the heating of the ink stored in the ink tank 24-1 by the ink temperature control unit 21-1 are started at the notification time T0.

Then, when the ink circulation control unit 26 determines "H3≦H2" at time T1, the control unit 25 suspends the drive of the nozzle array driving unit 17-1-1 which is the heating, and then the control unit 25 starts the drive of the nozzle array driving unit 17-1-1 to perform the recording process at the normal application voltage.

Then, the control unit 25 starts the drive of the ink circulation pump 20-1 when the ink circulation control unit 26 determines "H3≦H1".

Figure 6:
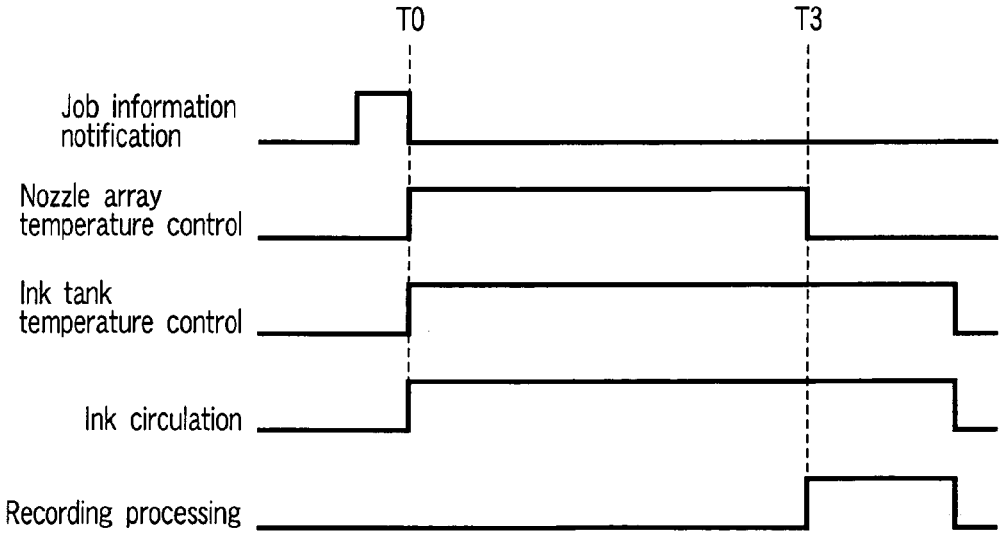
FIG. 6 is a timing chart showing third ink circulation control processing in the image recording apparatus.

FIG. 6 is a timing chart showing third ink circulation control processing of the embodiment.

In the third ink circulation control processing, as a result of analysis by the ink circulation control unit 26 of the job information of which the host apparatus 28 notifies the ink circulation control unit 26, the recording process which is the analyzed job information is not performed only by the ink stored in the ink chamber 32 communicated with the common ink flow channel 18*c* and the plural nozzles of the nozzle array 18-1-1, and the ink temperature control unit 21-1 determines that the ink temperature of the ink stored in the ink tank 24-1 cannot be controlled in the recommended usage temperature range before the recording process is finished by the ink stored in the ink chamber 32 communicated with the plural nozzles of the nozzle array 18-1-1.

That is, at a notification time T0 of the job information by the host apparatus 28, when the ink circulation control unit 26 determines "D1<D2" and "H3>H2", and when the ink circulation control unit 26 determines that the ink temperature in the ink tank 24-1 does not become "H3≦H1" during the recording process using the ink stored in the ink chamber 32 communicated with the plural nozzles, the heating of the ink stored in the plural ink chambers 32 of the nozzle array 18-1-1 by the drive of the nozzle array driving unit 17-1-1, the heating of the ink stored in the ink tank 24-1 by the ink temperature control unit 21-1, and the ink circulation by the ink circulation pump 20-1 are started at the notification time T0.

Then, when the ink circulation control unit 26 determines "H3≦H2" and "H3≦H1" at a time T3, the control unit 25 suspends the drive of the nozzle array driving unit 17-1-1 which is the heating, and then the control unit 25 starts the drive of the nozzle array driving unit 17-1-1 to perform the recording process at the normal application voltage.

The ink circulation control processing and recording process of the image recording apparatus of the embodiment will be described below.

Figure 7:
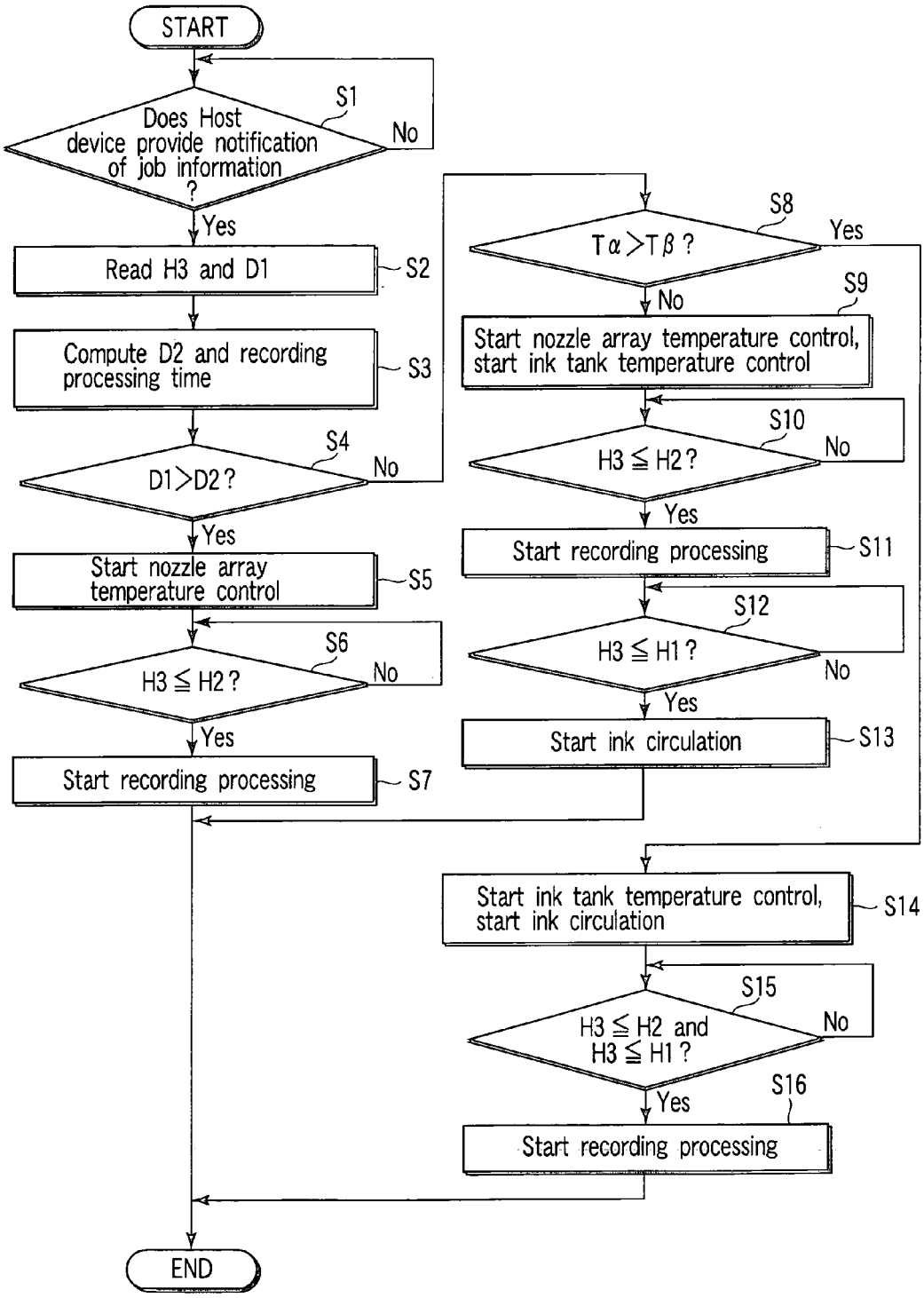
FIG. 7 is a flowchart showing ink circulation control processing/recording process in the image recording apparatus.

FIG. 7 is a flowchart showing the ink circulation control processing and recording process of the image recording apparatus of the embodiment.

The MPU in the control unit 25 of the image recording apparatus 1 of the embodiment executes the control program which is the ink circulation control unit 26 to realize the processing of each step shown in FIG. 7. It is assumed that the MPU in the control unit 25 performs parallel processing for pieces of processing of subsequent steps when the MPU in the control unit 25 is in a standby state in control program determination processing.

In the description of FIG. 7, it is assumed that the image recording apparatus 1 of the embodiment includes the one recording unit 4-1 and the one ink circulation unit 5-1 (see FIG. 3).

In the description of FIG. 7, it is assumed that all the ink temperatures of the ink stored in the image recording apparatus 1 are lower than the recommended usage temperature range at the time host apparatus 28 notifies the image recording apparatus 1 of the job information.

In Step S1, the control unit 25 determines whether or not the host apparatus 28 notifies the control unit 25 of the job information.

When the control unit 25 determines that the host apparatus 28 notifies the control unit 25 of the job information (YES in Step S1), the flow goes to Step S2. In Step S2, the control unit 25 reads the ink temperature range H3 and the total amount of ink D1 from the storage unit 27. The ink temperature range H3 is suitable for the recording process of the ink specified by the recording data of the job information. The total amount of ink D1 is stored in the ink chamber 32 communicated with the common ink flow channel 18*c* and plural nozzles. Then, the flow goes to Step S3.

The control unit 25 is in the standby state in Step S1, when the control unit 25 determines that the host apparatus 28 does not notify the control unit 25 of the job information (NO in Step S1).

In Step S3, the control unit 25 analyzes the notified job information to compute the total amount of ink D2 consumed by performing the job in terms of the total number of jets of the ink ejected from the plural nozzles in the recording process and a recording process time (including times for feeding and discharging the recording medium 10) by the job. Then the flow goes to Step S4.

In Step S4, the control unit 25 compares the total amount of ink D1 and the total amount of consumed ink D2 to determine whether or not the total amount of ink D1 is more than the total amount of consumed ink D2.

When the control unit 25 determines that the total amount of ink D1 is more than the total amount of consumed ink D2 (YES in Step S4), the flow goes to Step S5 to start the nozzle array temperature control.

When the control unit 25 determines that the total amount of ink D1 is not more than the total amount of consumed ink D2 (NO in Step S4), the flow goes to Step S8.

In Step S6, the control unit 25 compares the ink temperature range H3 suitable for the recording process of the ink specified by the recording data of the job information and the ink temperature H2 of the ink stored in the ink chamber 32 communicated with the common ink flow channel 18*c* and plural nozzles.

When the control unit 25 determines that the ink temperature range H3 is not more than the ink temperature H2 (YES in Step S6), the flow goes to Step S7 to start the recording process.

When the control unit 25 determines that the ink temperature range H3 is more than the ink temperature H2 (NO in Step S6), the control unit 25 is in the standby state in Step S6.

In Step S8, the control unit 25 compares a time Tα during which the ink in the ink tank 24-1 reaches the optimum ink temperature and a time Tβ during which the ink is eliminated in the nozzle array 18-1-1. Time Tα during which the ink in the ink tank 24-1 reaches the optimum ink temperature is a predicted heating time when the ink temperature control unit 21-1 heats the ink stored in the ink tank 24-1 to the optimum ink temperature range. The predicted heating time is previously stored in the storage unit 27 by forming a table indicating a relationship between the ink temperature value (ink temperature value in the beginning of the heating) detected in each color by the ink tank temperature sensor 22 and the corresponding heating time during which the ink is heated to the optimum ink temperature range.

Time Tβ during which the ink is eliminated in the nozzle array 18-1-1 is computed using the total amount of ink D1 and the amount of remaining ink. The total amount of ink D1 is computed from the volume of the ink flow channel 18*c* previously stored in the storage unit 27 and the total volume in the plural ink chambers 32 of the nozzle array 18-1-1. The amount of remaining ink is computed using the total amount of ink consumed by performing the last-time (previous) job.

When the control unit 25 determines that time Tα is more than time Tβ (YES in Step S8), the flow goes to Step S14. In Step S14, the control unit 25 starts the ink tank temperature control and the ink circulation.

When the control unit 25 determines that time Tα is not more than time Tβ (NO in Step S8), the flow goes to Step S9. In Step S9, the control unit 25 performs the nozzle array temperature control and the ink tank temperature control.

In Step S10, the control unit 25 compares the ink temperature range H3 suitable for the recording process of the ink specified by the recording data of the job information and the ink temperature H2 of the ink stored in the ink chamber 32 communicated with the common ink flow channel 18*c* and the plural nozzles.

When the control unit 25 determines that the ink temperature range H3 is not more than the ink temperature H2 (YES in Step S10), the flow goes to Step S11 to start the recording process.

When the control unit 25 determines that the ink temperature range H3 is more than the ink temperature H2 (NO in Step S10), the control unit 25 is in the standby state in Step S10.

In Step S12, the control unit 25 compares the ink temperature range H3 suitable for the recording process of the ink specified by the recording data of the job information and the ink temperature H1 of the ink stored in the ink tank.

When the control unit 25 determines that the ink temperature range H3 is not more than the ink temperature H1 (YES in Step S12), the flow goes to Step S13 to start the ink circulation, and the processing of the program is ended (END).

When the control unit 25 determines that the ink temperature range H3 is more than the ink temperature H1 (NO in Step S12), the control unit 25 is in the standby state in Step S12.

In Step S15, the control unit 25 compares the ink temperature range H3 suitable for the recording process of the ink specified by the recording data of the job information, with the ink temperature H2 of the ink stored in the ink chamber 32 communicated with the common ink flow channel 18*c* and plural nozzles, and with the ink temperature H1 of the ink stored in the ink tank.

When the control unit 25 determines that the ink temperature range H3 is not more than the ink temperature H2 and the ink temperature range H3 is not more than the ink temperature H1 (YES in Step S15), the flow goes to Step S16 to start the recording process.

When the control unit 25 determines that the ink temperature range H3 is not more than the ink temperature H2 and the ink temperature range H3 is more than the ink temperature H1 (NO in Step S15), the control unit 25 is in the standby state in Step S15.

Thus, in the embodiment, the ink circulation control unit 26 analyzes the job information of which the host apparatus 28 notifies the control unit 25, and the control unit 25 controls the nozzle array driving unit 17-1-1 to heat only the ink stored in the ink chamber 32 communicated with the common ink flow channel 18*c* and the plural nozzles of the nozzle array 18-1-1 when the control unit 25 determines that the recording process by the job can be performed only by the ink stored in the ink chamber 32 communicated with the common ink flow channel 18*c* and the plural nozzles of the nozzle array 18-1-1 (first ink circulation control processing). Therefore, according to the embodiment, the time to start the recording process can be shortened and power consumption for heating the ink can be minimized.

Additionally, in the embodiment, the ink circulation control unit 26 analyzes the job information of which the host apparatus 28 notifies the control unit 25, and the control unit 25 controls the nozzle array driving unit 17-1-1 to heat only the ink initially stored in the common ink flow channel 18*c* and ink chamber 32 when the control unit 25 determines that the recording process by the job is not ended only by the ink stored in the ink chamber 32 communicated with the common ink flow channel 18*c* and the plural nozzles of the nozzle array 18-1-1, but the ink circulation is required to be started in the middle of the recording process by the job to replenish the ink for the recording process (second ink circulation control processing). Therefore, according to the embodiment, the time to start the recording process can be shortened.

Additionally, in the embodiment, the ink circulation control unit 26 analyzes the job information of which the host apparatus 28 notifies the control unit 25, the control unit 25 causes the ink temperature control unit to immediately heat the ink stored in the ink tank 24-1 based on the determination result that the recording process by the job is not ended only by the ink stored in the ink chamber 32 communicated with the common ink flow channel 18*c* and the plural nozzles of the nozzle array 18-1-1, and the control unit 25 controls the ink circulation pump 20-1 after the ink temperature in the ink tank 24-1 reaches the ink temperature range suitable for the recording process of the ink. Therefore, according to the embodiment, the power consumption for heating the ink can be minimized.

Furthermore, in the embodiment, the ink circulation control unit 26 analyzes the job information of which the host apparatus 28 notifies the control unit 25, which allows the temperature to be always adjusted in the temperature range suitable for the recording process to the ink used in the recording process by the job. Therefore, according to the embodiment, the image deterioration due to the change in ink viscosity can surely be avoided.

The invention is not limited to the embodiment, but the following modification may be made.

In the embodiment, the nozzle array driving unit 17 is controlled to heat the ink stored in the ink chamber 32 communicated with the ink flow channel 18*c* and the plural nozzles of the nozzle array 18. However, the invention is not limited to the configuration of the embodiment. For example, the ink may be heated by providing the heater in the common ink flow channel 18*c*.

In the embodiment, the heater is used as the ink temperature control unit 21, or the heater and the Peltier device are provided when the ink is also cooled. However, the invention is not limited to the configuration of the embodiment. For example, the heating/cooling may be performed by providing only the Peltier device.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image recording apparatus comprising:

at least one recording unit which includes at least one nozzle array formed by a plurality of nozzles each being communicated with a corresponding ink chamber, and which performs with a corresponding ink chamber, and which performs control of a temperature of ink stored in said each ink chamber and acquisition of nozzle array temperature detection information regarding the temperature of the stored ink;

an ink tank in which control of a temperature of stored ink and acquisition of ink tank temperature detection information regarding the temperature of the stored ink are performed;

an ink circulation unit which performs nozzle array ink circulation such that the ink stored in the ink tank is returnable to the ink tank after the ink passes through said each ink chamber;

an ink circulation control unit which analyzes an amount of ink to be consumed in performing a job and an optimum ink recording temperature for performing said job, based on job information notified by a host apparatus, so as to generate an analysis result; and a control unit with controls at least one of the heating of the ink stored in said each ink chamber, heating of the ink stored in the ink tank, and the nozzle array ink circulation, based on the analysis result of the ink circulation control unit, the nozzle array temperature detection information, and the ink tank temperature detection information.

2. The image recording apparatus according to claim 1, wherein, assuming that H1 is an ink temperature of the ink stored in the ink tank, H2 is an ink temperature of the ink stored in said each ink chamber, H3 is the optimum ink recording temperature of the ink suitable for a recording process based on recording data of the job information notified by the host apparatus, D1 is a total amount of ink stored in said each ink chamber, and D2 is the amount of ink to be consumed in performing said job in terms of a total number of jets of the ink jetted from said plurality of nozzles, the control unit at least controls a nozzle array driving unit to heat the ink stored in said each ink chamber, based on a comparison result of D1 and D2, a comparison result of the ink temperature H3 and the ink temperature H1, and a comparison result of the ink temperature H3 and the ink temperature H2.

3. The image recording apparatus according to claim 2, wherein the control unit controls the nozzle array driving unit to heat only the ink stored in said each ink chamber, when it is determined that D1>D2 and that H3>H2, and wherein the control unit performs the recording process after stopping the control of the nozzle array driving unit for heating the ink stored in said each ink chamber, when it is determined that H3≦H2.

4. The image recording apparatus according to claim 2, wherein the control unit controls to simultaneously heat the ink stored in said each ink chamber and the ink stored in the ink tank, when it is determined that D1<D2, that H3>H2, and that the temperature of the ink in the ink tank will satisfy H3≦H1 during the recording process using the ink stored in said each ink chamber, and wherein the control unit performs the recording process after stopping the control of the nozzle array driving unit for heating the ink stored in said each ink chamber, when it is determined that H3≦H2, and then the control unit performs the nozzle array ink circulation when it is determined that H3≦H1.

5. The image recording apparatus according to claim 2, wherein the control unit controls to simultaneously start heating of the ink stored in said each ink chamber and the ink stored in the ink tank, and the nozzle array ink circulation, when it is determined that D1<D2, that H3>H2, and that the temperature of the ink in the ink tank will not satisfy H3≦H1 during the recording process using the ink stored in said each ink chamber, and wherein the control unit performs the recording process after stopping the control of the nozzle array driving unit for heating the ink stored in said each ink chamber, when it is determined that H3≦H2 and that H3≦H1.

6. A method for controlling ink circulation in an image recording apparatus that comprises:

(i) at least one recording unit which includes at least one nozzle array formed by a plurality of nozzles each being communicated with a corresponding ink chamber, and which performs control of a temperature of ink stored in said each ink chamber and acquisition of nozzle array temperature detection information regarding the temperature of the stored ink; (ii) an ink tank in which control of a temperature of stored ink and acquisition of ink tank temperature detection information regarding the temperature of the stored ink are performed; and (iii) an ink circulation unit which performs nozzle array ink circulation such that the ink stored in the ink tank is returnable to the ink tank after the ink passes through said each ink chamber, the method comprising:

analyzing an amount of ink to be consumed in performing a job and an optimum ink recording temperature for performing the job, based on job information notified by a host apparatus;

determining control contents for controlling the ink circulation unit based on a result of the analysis, the nozzle array temperature detection information and the ink tank temperature detection information; and controlling the ink circulation unit based on the determined control contents;

wherein, assuming that H1 is an ink temperature of the ink stored in the ink tank, H2 is an ink temperature of the ink stored in said each ink chamber, H3 is the optimum ink recording temperature of the ink suitable for a recording process based on recording data of the job information notified by the host apparatus, D1 is a total amount of ink stored in said each ink chamber, and D2 is the amount of ink to be consumed in performing the job in terms of a total number of jets of the ink ejected from said plurality of nozzles, at least the ink stored in said each ink chamber is heated by control of a nozzle array driving unit, based on a comparison result of D1 and D2, a comparison result of the ink temperature H3 and the ink temperature H1, and a comparison result of the ink temperature H3 and the ink temperature H2.

7. The ink circulation control method according to claim 6, wherein only the ink stored in said each ink chamber is heated by control of the nozzle array driving unit, when it is determined that D1>D2 and that H3>H2, and the recording process is performed after the control of the nozzle array driving unit for heating the ink stored in said each ink chamber is stopped, when it is determined that H3≦H2.

8. The ink circulation control method according to claim 6, wherein the ink stored in said each ink chamber and the ink stored in the ink tank are simultaneously heated, when it is determined that D1<D2, that H3>H2, and that the temperature of the ink stored in the ink tank will satisfy H3≦H1 during the recording process using the ink stored in said each ink chamber, and wherein the recording process is performed after the control of the nozzle array driving unit for heating the ink stored in said each ink chamber is stopped, when it is determined that H3≦H2, and then the nozzle array ink circulation is started when it is determined that H3≦H1.

9. The ink circulation control method according to claim 6, wherein the heating of the ink stored in said each ink chamber and the ink stored in the ink tank, and the nozzle array ink circulation are simultaneously started, when it is determined that D1<D2, that H3>H2, and that the temperature of the ink stored in the ink tank will not satisfy H3≦H1 during the recording process using the ink stored in said each ink chamber, and wherein the recording process is performed after the control of the nozzle array driving unit for heating the ink stored in said each ink chamber is stopped, when it is determined that H3≦H2 and that H3≦H1.

* * * * *